US009849314B2

(12) United States Patent
Tekelenburg et al.

(10) Patent No.: US 9,849,314 B2
(45) Date of Patent: Dec. 26, 2017

(54) BREATHING APPARATUS WITH ILLUMINATED CONNECTION

(71) Applicant: MSA TECHNOLOGY, LLC, Cranberry Township, PA (US)

(72) Inventors: Marco Tekelenburg, Zelienople, PA (US); Henry Fonzi, Cranberry Township, PA (US)

(73) Assignee: MSA Technology, LLC, Cranberry Township, PA (US)

( * ) Notice: Subject to any disclaimer, the term of this patent is extended or adjusted under 35 U.S.C. 154(b) by 75 days.

(21) Appl. No.: 14/144,339

(22) Filed: Dec. 30, 2013

(65) Prior Publication Data

US 2015/0151145 A1 Jun. 4, 2015

Related U.S. Application Data

(60) Provisional application No. 61/910,187, filed on Nov. 29, 2013.

(51) Int. Cl.

| | |
|---|---|
| ***A62B 9/00*** | (2006.01) |
| ***A62B 9/04*** | (2006.01) |
| ***A62B 7/02*** | (2006.01) |

(52) U.S. Cl.

CPC ..... *A62B 9/006* (2013.01); *A62B 7/02* (2013.01); *A62B 9/04* (2013.01); *Y10T 137/0396* (2015.04); *Y10T 137/8376* (2015.04)

(58) Field of Classification Search

CPC ..... A62B 9/04; A62B 7/02; A61M 39/1011; A61M 16/0816

USPC ..... 141/2, 3; 224/663, 262, 271, 633; 362/96, 478; 128/202.13; 285/93

See application file for complete search history.

(56) References Cited

U.S. PATENT DOCUMENTS

| | | | | | |
|---|---|---|---|---|---|
| 1,985,483 | A | * | 12/1934 | Clarke | E05B 17/10 362/100 |
| 2,406,888 | A | * | 9/1946 | Meidenbauer, Jr. | A62B 7/02 128/202.27 |
| 3,128,952 | A | * | 4/1964 | Bloom | 362/96 |
| 4,498,471 | A | * | 2/1985 | Kranz | A62B 9/022 128/202.22 |
| 4,638,410 | A | * | 1/1987 | Barker | 362/105 |
| 4,713,733 | A | * | 12/1987 | Fitz | B60N 3/14 219/220 |
| 4,821,767 | A | | 4/1989 | Jackson | |
| 5,016,627 | A | | 5/1991 | Dahrendorf | |

(Continued)

OTHER PUBLICATIONS

International Search Report of International PCT application PCT/US2014/067236 counterpart of the present US patent application.

(Continued)

*Primary Examiner* — Jason K Niesz
*Assistant Examiner* — James Hakomaki
(74) *Attorney, Agent, or Firm* — Bartony & Associates, LLC

(57) ABSTRACT

A breathing system includes a tank for pressurized breathing gas, at least one regulator comprising a connection to which the tank is attachable, a universal air connector in fluid connection with the connection, and at least one light source, the light source, when illuminated, providing a guide to connect a connector in fluid connection with a secondary tank to the universal air connector to supply breathing gas to the tank.

18 Claims, 4 Drawing Sheets

(56) References Cited

U.S. PATENT DOCUMENTS 5,057,975 A * 10/1991 Evigan ..... E05B 17/10 362/100
5,097,826 A * 3/1992 Gray ..... A62B 9/006 128/202.22
5,396,885 A * 3/1995 Nelson ..... 128/204.18
5,529,096 A * 6/1996 Rowe et al. ..... 141/21
5,781,118 A * 7/1998 Wise ..... A62B 9/006 340/573.1
6,070,577 A * 6/2000 Troup ..... 128/205.22
6,091,331 A * 7/2000 Toft ..... A62B 9/00 340/321
6,168,282 B1 * 1/2001 Chien ..... F21V 19/006 362/228
6,293,685 B1 * 9/2001 Polkow ..... F21V 33/0076 116/286
6,915,965 B2 * 7/2005 Siebert ..... A62C 33/00 128/202.13
7,036,948 B1 * 5/2006 Wyatt ..... H01R 13/717 362/276
7,168,428 B1 * 1/2007 Zoha ..... 128/202.27
8,122,763 B2 * 2/2012 Fundak ..... A62B 9/006 128/201.27
8,128,269 B2 * 3/2012 Boyadjieff ..... G08B 5/002 340/306
8,256,420 B2 9/2012 Prete
8,678,049 B2 * 3/2014 Roys ..... B67D 7/344 141/1
2002/0126471 A1 * 9/2002 Becnel ..... F21K 2/06 362/34
2004/0042200 A1 * 3/2004 Hurwitz ..... 362/84
2005/0233633 A1 * 10/2005 Chien ..... H01R 13/6691 439/502
2008/0041379 A1 2/2008 Turiello
2008/0257928 A1 10/2008 Lowry
2008/0261440 A1 * 10/2008 Buzil ..... H01R 13/70 439/490
2009/0059568 A1 * 3/2009 Kormos ..... A62B 33/00 362/103
2010/0300436 A1 * 12/2010 McKeown ..... A62B 7/02 128/202.13
2011/0197891 A1 * 8/2011 Sanders ..... A62B 9/04 128/205.22
2012/0067348 A1 3/2012 Steck
2012/0120638 A1 * 5/2012 Gonzalez ..... A45C 13/30 362/154
2012/0160245 A1 6/2012 Leuschner
2012/0169044 A1 * 7/2012 Kendrick ..... A61M 16/0816 285/313
2012/0305127 A1 * 12/2012 Roys ..... B67D 7/344 141/1
2013/0201667 A1 * 8/2013 Ratner ..... F21V 33/0076 362/158
2014/0118998 A1 * 5/2014 Mabry ..... F21L 4/02 362/184

OTHER PUBLICATIONS

Written Opinion of International PCT application PCT/US2014/067236 counterpart of the present US patent application.

* cited by examiner

BREATHING APPARATUS WITH ILLUMINATED CONNECTION

CROSS-REFERENCE TO RELATED APPLICATIONS

This application claims benefit of U.S. Provisional Patent Application Ser. No. 61/910,187, filed Nov. 29, 2013, the disclosure of which is incorporated herein by reference.

BACKGROUND

The following information is provided to assist the reader in understanding technologies disclosed below and the environment in which such technologies may typically be used. The terms used herein are not intended to be limited to any particular narrow interpretation unless clearly stated otherwise in this document. References set forth herein may facilitate understanding of the technologies or the background thereof. The disclosure of all references cited herein are incorporated by reference.

A self-contained breathing apparatus ("SCBA") is a device used to enable breathing in environments which are immediately dangerous to life and health (sometimes referred to as "IDLH" environments). For example, firefighters wear an SCBA when fighting a fire. The SCBA typically has a harness or carrier system including a backplate supporting an air tank which is connected to a facepiece, all of which are worn or carried by the user. The tank typically contains air or oxygen-containing breathing gas under high pressure (for example, 2200-5500 psi or 15,168 to 37921 kPa) and is connected to a first stage regulator which reduces the pressure to about 80-100 psi or 552 to 689 kPa. The SCBA usually has a second stage regulator that has an inlet valve which controls the flow of air for breathing between the air tank and the facepiece. Typically, the inlet valve controls the flow of air through the second state regulator in response to the respiration of the user. Such respiration-controlled regulator assemblies are disclosed, for example, in U.S. Pat. Nos. 4,821,767 and 5,016,627.

Under the 2002 edition of NFPA 1981 (Standard on Open Circuit Self-Contained Breathing Apparatus for Fire and Emergency Services), manufacturers must include a Rapid Intervention Crew/Universal Air Coupling (RIC/UAC), sometimes referred to herein as a universal air coupling or UAC in SCBAs to be in compliance for firefighting. The UAC allows a cylinder that is low on air to be "transfilled" from another, secondary cylinder regardless of the manufacturer thereof. After the transfilling process, each cylinder may, for example, have an equal amount of air. The UAC must be permanently fixed to the SCBA within four inches of the threads of the SCBA cylinder valve.

SUMMARY

In one aspect, a breathing system includes a tank for pressurized breathing gas, at least one regulator comprising a connection to which the tank is attachable, a universal air connector in fluid connection with the connection, and at least one light source, the light source, when illuminated, providing a guide to connect a connector in fluid connection with a secondary air supply (such as a secondary air tank) to the universal air connector to supply breathing gas to the tank. The breathing system may, for example, include a first stage regulator comprising the connection and a second stage regulator in fluid connection with the first stage regulator.

In a number of embodiments, the breathing system further includes a controller in operative connection with the at least one light source. The controller is operative to place the light source in an on state. The breathing system may further include a pressure sensor in operative connection with the controller. The pressure sensor is in fluid connection with the tank. The controller places the light source in the on state upon receiving a signal from the pressure sensor indicating that a pressure in the tank is at or below a predetermined first pressure. In a number of embodiments, the controller places the light source in an off state upon receiving a signal form the pressure sensor indicating the pressure in the tank is at or above a predetermined second pressure. In a number of other embodiments, the controller places the light source in an off state at a predetermined period of time after receiving a signal from the pressure sensor indicating the pressure in the tank is at or above a predetermined second pressure. The predetermined second pressure may, for example, be greater than or equal to the predetermined first pressure. In a number of embodiments, the predetermined second pressure is equal to the predetermined first pressure.

The at least one light source may, for example, project light which is incident upon the universal air connector. The at least one light source may be positioned upon a portion of the universal air connector. The at least one light source may also be positioned in the vicinity of the universal air connector.

In a number of embodiments, the at least one light source is spaced from the universal air connector and projects light which is incident upon the universal air connector. The at least one light source may, for example, be positioned no more than 12 inches (0.3048 meters) from the universal air connector, no more than 6 inches (0.1524 meters) from the universal air connector, no more than 4 inches (0.1016 meters) from the universal air connector or no more than 3 inches (0.0762 meters) from the universal air connector. In a number of embodiments, the at least one light source is positioned in the range of approximately 2 to 4 inches from the universal air connector.

In another aspect, a method includes providing a breathing system comprising a tank for pressurized breathing gas; at least one regulator comprising a connection to which the tank is attached and a universal air connector in fluid connection with the connection; and illuminating at least one light source operatively connected to the breathing system to provide a guide to connect a connector in fluid connection with a secondary air supply (for example, a second air tank) to the universal air connector to supply breathing gas to the tank.

The present devices, systems, and methods, along with the attributes and attendant advantages thereof, will best be appreciated and understood in view of the following detailed description taken in conjunction with the accompanying drawings.

DETAILED DESCRIPTION

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

As used herein and in the appended claims, the singular forms "a," "an", and "the" include plural references unless the context clearly dictates otherwise. Thus, for example, reference to "a light source" includes a plurality of such light sources and equivalents thereof known to those skilled in the art, and so forth, and reference to "the light source" is a reference to one or more such light sources and equivalents thereof known to those skilled in the art, and so forth.

Figure 1:
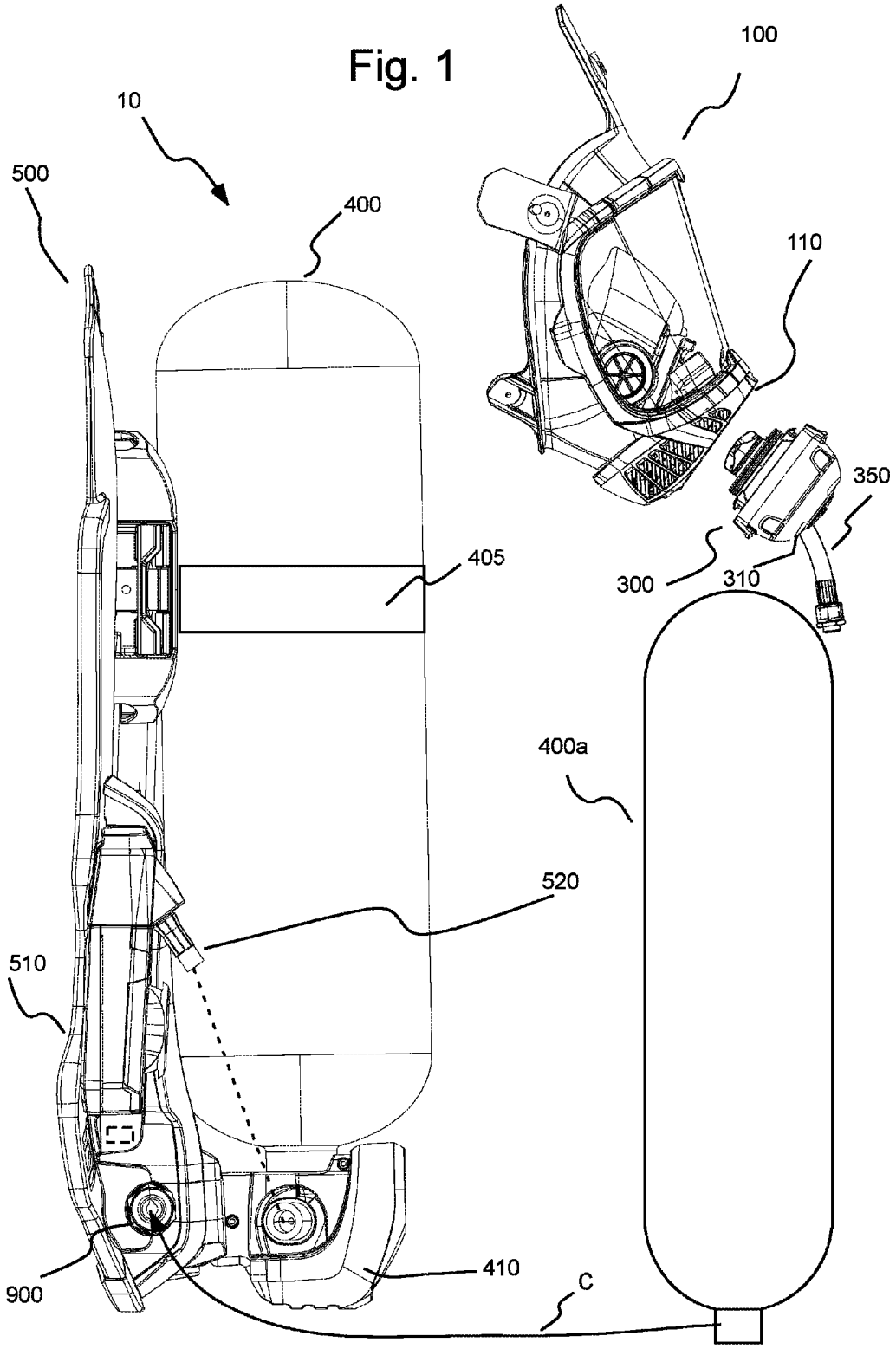
FIG. 1 illustrates an embodiment of a self-contained breathing apparatus (SCBA) hereof

FIG. 1 illustrates an embodiment of a breathing system 10 hereof such as an SCBA. In the illustrated embodiment, breathing system 10 includes a facepiece 100 to be worn by a user. Facepiece 100 forms a sealed volume surrounding the nose and mouth of the user into which breathing gas in introduced. In that regard, facepiece 100 includes a regulator interface portion 110 of facepiece 100 to place facepiece 100 in fluid connection with a second stage pressure regulator assembly 300 so that pressurized air can be supplied from a pressurized air tank 400 via high-pressure hosing 350. A facepiece suitable for use in breathing system 10 is described, for example, in U.S. Patent Application Publication No. 2012/0160245 and U.S. Pat. No. 8,256,420, the disclosures of which are incorporated herein by reference. Likewise, a second stage pressure regulator suitable for use in connection therewith is described, for example, in U.S. Patent Application Publication No. 2012/0160245 and U.S. Pat. No. 8,256,420.

Pressurized air tank 400 is supported on and strapped to a harness or carrier system 500 that is worn by the user of system 10. In the illustrated embodiment, carrier system 500 includes a backplate 510 to support tank 400 and strapping (not shown) to connect backplate 510 to the user. A tank strap 405 (for example, a metal strap) assists in retaining tank 400 in connection with backplate 510. A valve 410 provides air from pressurized tank 400 to a connector 520 in fluid connection with a first stage regulator 700 via a connector 520*a* in fluid connection with connector 520 and a connector 710 (see, for example, FIGS. 2) in fluid connection with first stage regulator 700. As described above, tank 400 may, for example, contain air or oxygen-containing breathing gas under high pressure (for example, in the range of 2200-4500 psi). First stage regulator 700 reduces the pressure to, for example, about 80 psi. Breathing gas leaves first stage regulator 700 via a connector 720 and flows to inlet 310 of second stage regulator 300 via high pressure hosing 350 (a portion of which is shown FIG. 1).

As described above, breathing system 10 includes a Rapid Intervention Crew/Universal Air Coupling or UAC 800. As, for example, illustrated in FIG. 2C, UAC 800 is in fluid connection with connector 710 and, thereby, in fluid connection with tank 400 when tank 400 is in fluid connection with connector 710. UAC 800 thereby allows tank 400, when low on air/breathing gas, to be "transfilled" from another source of pressurized breathing gas such as another cylinder (for example, secondary tank 400*a* as illustrated in FIG. 1) regardless of the manufacturer thereof. Tank 400 can also, for example, be filled from a compressor of from a cascade system (including, a plurality of cylinders). Firefighters, however, inherently work in conditions of low visibility resulting from smoke and airborne debris associated with fires and other emergency conditions. Moreover, the turnout gear and gloves worn by firefighter can greatly reduce the manual dexterity of a rapid intervention crew member trying to locate UAC 800. Thus locating (both visually and tactilely) a UAC and connecting to the UAC by a rapid intervention crewmember can often be very difficult.

In a number of embodiments hereof, the position of UAC 800 is made readily locatable, even under conditions of poor visibility by lighting or illuminating at least a portion of UAC 800 or the vicinity of UAC 800, either directly or indirectly. The illumination provides a guide for a person other than the user of breathing system 10 (for example, a rapid intervention crewmember) to locate and connect to UAC 800 to fill/transfill tank 400 via a secondary tank 400*a* (see, FIG. 1). In that regard, tank 400*a* (or another source of breathing gas) has a universal connector (represented by arrow C in FIG. 1) which connects to UAC 800 to fill/transfill UAC 800.

Figure 2:
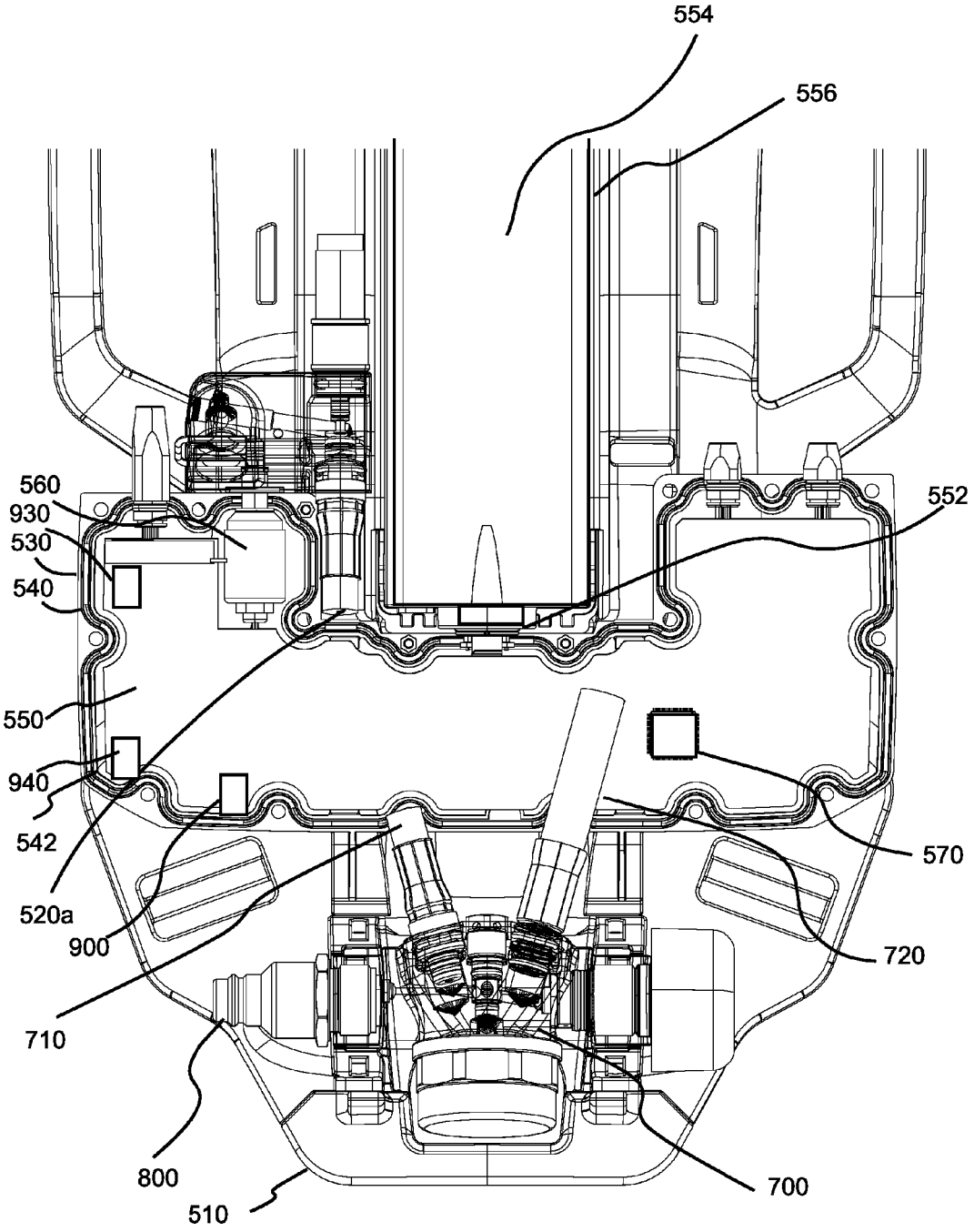
FIG. 2 illustrates a cutaway view of a portion of a backplate of the carrier system of FIG. 1 including electronic circuitry and the UAC.
Figure 3:
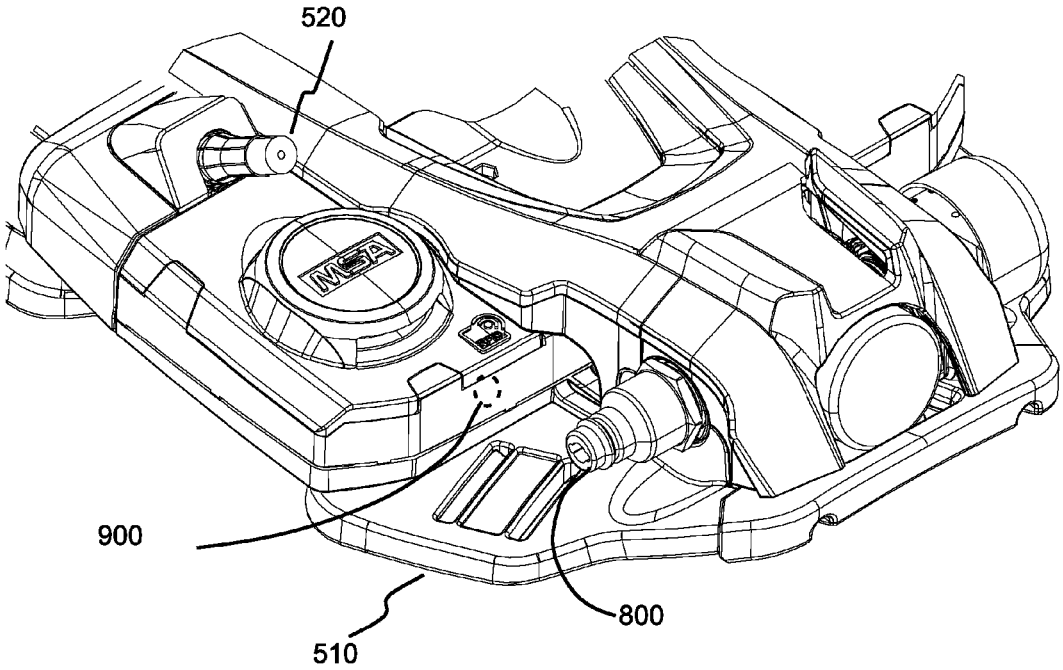
FIG. 3 illustrates a perspective view of a portion of the backplate of the carrier system of FIG. 1.

As, for example, illustrated in FIGS. 2 and 3, a light source 900, may be positioned on or in operative connection with carrier system 500 to illuminate at least a portion of UAC 800. In the embodiment illustrated in FIGS. 1 through 3, light source 900 is positioned within a power module and electronics assembly, referred to herein as electronics assembly 530. In a number of embodiments, light source 900 shines through a translucent panel 542 of a compartment 540 enclosing a portion of electronics assembly 530 to illuminate at least a portion of UAC 800.

Light source 900 is in electronic connection with circuitry including, for example, a printed circuit board 550, which is in electrical connection (via a connector 552) with a power source including, for example, one or more batteries 554 positioned within a battery compartment 556. In the illustrated embodiment, the illumination of light source 900 (for example, on/off switching) is controlled as a function of the pressure of the breathing gas in tank 400. Illuminating light source 900 only during a low pressure state may, for example, assist in conserving battery power. In the illustrated embodiment, a pressure sensor or transducer 560 is in fluid connection with connector 520 and thereby with tank 400. Transducer is also in electrical connection with the circuitry of circuit board 550, including, for example, a controller system including, for example, one or more processors 570. (for example, a microprocessor).

In a number of embodiments, signals of measured pressure are transmitted from pressure sensor 560 to microprocessor 570. Microprocessor 570 controls light source 900 such that light source 900 is illuminated when the pressure in tank 400 is determined to be at or below a certain predefined level. For example, light source 900 may be illuminated when the measured pressure of tank 400 is at or below a low pressure limit (or in a low-pressure state) as, for example, defined by a measured pressure in the range of 25-33% of pressure of the tank 400 when full.

The illumination of light source 900 also provides an indication to persons other than the user of a low-pressure condition of tank 400. In a number of embodiments, a periodic pulsing of light source 900 and a frequency of such pulsing may, for example, be used to provide information to persons other than the user related to the measured pressure of tank 400. For example, light source 900 may pulse slowly upon a low pressure state first being sensed (for example, at a pressure level of 33%). The frequency of pulsing may, for example, be increased as measured pressure decreases until a critical pressure level is reached at which point light source 900 may be illuminated continuously.

In a number of embodiments, light source 900 remains continuously illuminated after sensing the predetermined low pressure state. Other light sources, such as light sources 930 and 940 may, for example, be used to provide information to persons other than the user regarding the pressure level of tank 400. Color and/or frequency of pulsation of light sources 930 and 940 may, for example, be used to provide information regarding the measure pressure level.

As described above, light source 900 illuminates at least a portion of UAC 800 to make UAC 800 readily locatable even under conditions of poor visibility. Once again, the illumination provides a guide for a person other than the user of breathing apparatus 10 to locate and connect to UAC 800. In a number of embodiments, light source 900 remains illuminated until tank 400 is brought to a predetermined pressure (for example, at a "second" predetermined pressure above the pressure defining the low-pressure state or at the "first" predetermined pressure, which defines the low-pressure state), at which point light source 900 is turned to an off state until the low-pressure state is once again sensed. In other embodiments, light source 900 may remain illuminated for, for example a period of time (for example, a predetermined period of time such as 30-60 seconds) after the first predetermined pressure (that is, the pressure defining the low-pressure state) is measured to provide the person transfilling tank 400 (for example, a member of a rapid intervention crew) guidance when disconnecting the connector of the filling tank from UAC 800. In general, transfilling or filling processes (from, for example, a secondary tank, a cascade system or a compressor system) occur relatively quickly and are typically accomplished within 30-90 seconds after connecting to UAC 800. Providing illumination from light source 900 for 30-60 seconds after the first predetermined pressure state is reached provides sufficient time to end the transfilling or filling process and disconnect from UAC 800.

Figure 4:
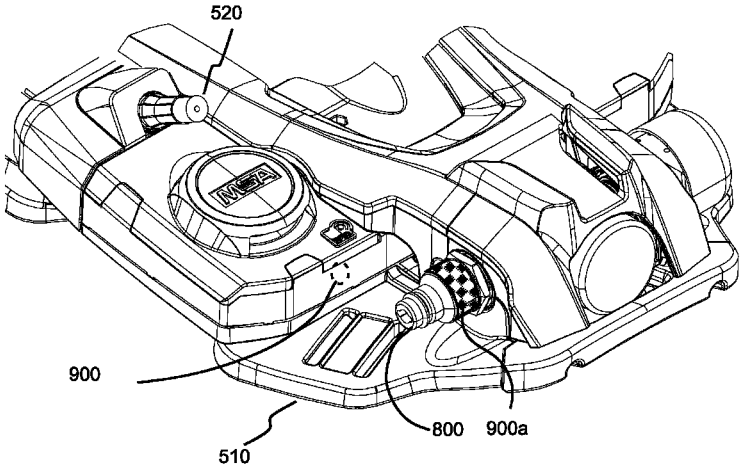
FIG. 4 illustrates a perspective view of a portion of another embodiment of a backplate.

FIG. 4 illustrates another embodiment of backplate 510 wherein a portion of UAC 800 includes a light source 900*a*, which operates in a manner similar to light source 900 as described above. In the illustrated embodiment, light source 900*a* is positioned on a portion of UAC 800 rearward of the portion thereof that cooperates with connector C in forming a connection therewith.

Figure 5:
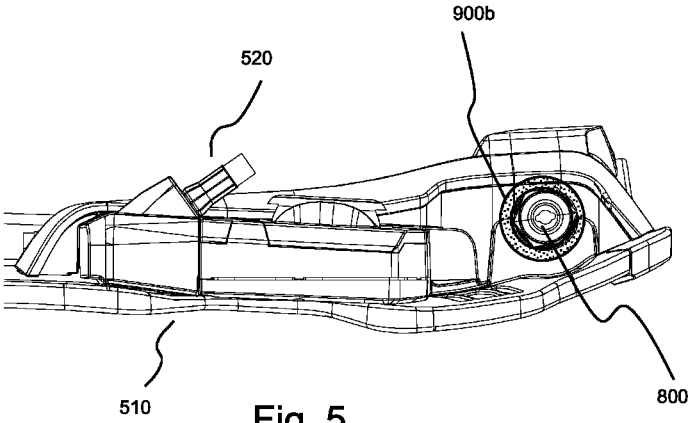
FIG. 5 illustrates a side view of a portion of another embodiment of a backplate.

FIG. 5 illustrates another embodiment of backplate 510 wherein an area in the vicinity of UAC 800 includes a light source 900*b*, which is illuminated in a manner similar to light source 900 as described above. Light source, 900*b* may but need not illuminate a portion of UAC 800. By illuminating the vicinity of UAC 800, light source 900*b* provides a guide for a person such as a member of a rapid intervention crew to connect connector C to UAC 800. In the illustrated embodiment, light source 900*b* has an annular shape and is positioned around a base of UAC 800. As is clear to one skilled in the art, many other configurations of one or more light sources may be used to provide guidance to a person or persons trying to connect a connector to UAC 800.

In general light sources such as light sources 900, 990*a* and/or 900*b*, which provide guidance to connect and disconnect to UAC 800, preferably provide white light at sufficient luminosity to provide such guidance in low visibility conditions. In general, light source 900 is positioned no more than 12 inches (0.305 meters) away from UAC 800. In a number of embodiments, light source 900 is positioned no more than 6 inches (0.152 meters), no more than 4 inches (0.102 meters), or no more than 3 inches (0.0.076 meters) away from UAC 800.

The foregoing description and accompanying drawings set forth a number of representative embodiments at the present time. Various modifications, additions and alternative designs will, of course, become apparent to those skilled in the art in light of the foregoing teachings without departing from the scope hereof, which is indicated by the following claims rather than by the foregoing description. All changes and variations that fall within the meaning and range of equivalency of the claims are to be embraced within their scope.

What is claimed is:

1. A breathing system, comprising:

a tank for pressurized breathing gas;

at least one regulator comprising a connection to which the tank is attachable;

a universal air connector in fluid connection with the connection;

a controller; and at least one light source in operative connection with the controller; the controller being operative to place the light source in an ON state when the universal air connector is not connected to a universal connector in fluid connection with a secondary air supply to provide a guide to connect the universal connector in fluid connection with the secondary air supply to the universal air connector to supply breathing gas to the tank, wherein the at least one light source is positioned to illuminate at least a portion of the universal air connector or to illuminate a portion of a base area surrounding the universal air connector when in the ON state.

2. The breathing system of claim 1 further comprising a first stage regulator comprising the connection and a second stage regulator in fluid connection with the first stage regulator.

3. The breathing system of claim 1 further comprising a pressure sensor in operative connection with the controller, the pressure sensor being in fluid connection with the tank, the controller placing the light source in the ON state upon receiving a signal from the pressure sensor indicating that a pressure in the tank is at or below a predetermined first pressure.

4. The breathing system of claim 3 wherein the controller places the light source in an OFF state upon receiving a signal from the pressure sensor indicating the pressure in the tank is at or above a predetermined second pressure.

5. The breathing system of claim 3 wherein the controller places the light source in an OFF state a predetermined period of time after receiving a signal form the pressure sensor indicating the pressure in the tank is at or above a predetermined second pressure.

6. The breathing system of claim 1 wherein the at least one light source projects light which is incident upon the universal air connector; the at least one light source is positioned upon a portion of the universal air connector, or the at least one light source is positioned at a base of the universal air connector.

7. The breathing system of claim 1 wherein the at least one light source is spaced from the universal air connector and projects light which is incident upon the universal air connector.

8. The breathing system of claim 7 wherein the at least one light source is positioned no more than 12 inches (0.3408 meters) from the universal air connector.

9. The breathing system of claim 7 wherein the at least one light source is positioned no more than 4 inches (0.1016 meters) from the universal air connector.

10. A method, comprising:

providing a breathing system comprising a tank for pressurized breathing gas; at least one regulator comprising a connection to which the tank is attached and a universal air connector in fluid connection with the connection;

illuminating at least one light source operatively connected to the breathing system when there is no universal connector in fluid connection with a secondary air supply in connection with the universal air connector to provide a guide to connect a connector in fluid connection with the secondary air supply to the universal air connector to supply breathing gas to the tank by illuminating at least a portion of the universal air connector or by illuminating a base area of the universal air connector via the at least one light source; and a controller in operative connection with the at least one light source, wherein the controller is operative to place the light source in an ON state.

11. The method of claim 10 wherein the breathing system further comprises a first stage regulator comprising the connection and a second stage regulator in fluid connection with the first stage regulator.

12. The method of claim 11 further comprising sensing pressure in the tank via a pressure sensor in operative connection with the controller, the pressure sensor being in fluid connection with the tank, the controller placing the light source in the ON state upon receiving a signal from the pressure sensor indicating that a pressure in the tank is at or below a predetermined first pressure.

13. The method of claim 12 wherein the controller places the light source in an OFF state upon receiving a signal form the pressure sensor indicating a pressure in the tank is at or above a predetermined second pressure.

14. The method of claim 12 wherein the controller places the light source in an OFF state a predetermined period of time after receiving a signal form the pressure sensor indicating the pressure in the tank is at or above a predetermined second pressure.

15. The method of claim 10 wherein the at least one light source projects light which is incident upon the universal air connector, the at least one light source is positioned upon a portion of the universal air connector, or the at least one light source is positioned at a base of the universal air connector.

16. The method of claim 10 wherein the at least one light source is spaced from the universal air connector and projects light which is incident upon the universal air connector.

17. The method of claim 16 wherein the at least one light source is positioned no more than 12 inches (0.3048 meters) from the universal air connector.

18. The method of claim 16 wherein the at least one light source is positioned no more than 4 inches (0.1016 meters) from the universal air connector.

* * * * *